US010711528B2

(12) United States Patent
Murdock et al.

(10) Patent No.: US 10,711,528 B2
(45) Date of Patent: Jul. 14, 2020

(54) DIAMOND CUTTING ELEMENTS FOR DRILL BITS SEEDED WITH HCP CRYSTALLINE MATERIAL

(71) Applicant: Ulterra Drilling Technologies, L.P., Fort Worth, TX (US)

(72) Inventors: Andrew David Murdock, Fort Worth, TX (US); Matthew Douglas Mumma, Weatherford, TX (US); John Martin Clegg, Fort Worth, TX (US); William Henry DuBose, Irving, TX (US); Neal Alan Bowden, Mansfield, TX (US)

(73) Assignee: Ulterra Drilling Technologies, L.P., Fort Worth, TX (US)

( * ) Notice: Subject to any disclaimer, the term of this patent is extended or adjusted under 35 U.S.C. 154(b) by 0 days.

(21) Appl. No.: 16/242,784

(22) Filed: Jan. 8, 2019

(65) Prior Publication Data

US 2019/0145181 A1 May 16, 2019

Related U.S. Application Data

(62) Division of application No. 13/891,040, filed on May 9, 2013, now Pat. No. 10,180,032.

(Continued)

(51) Int. Cl.

| | |
|---|---|
| ***E21B 10/56*** | (2006.01) |
| ***B24D 3/10*** | (2006.01) |
| ***B24D 18/00*** | (2006.01) |

(Continued)

(52) U.S. Cl.

CPC ..... *E21B 10/56* (2013.01); *B24D 3/10* (2013.01); *B24D 18/00* (2013.01); *B24D 99/005* (2013.01);

(Continued)

(58) Field of Classification Search

CPC ..... E21B 2010/543; E21B 2010/563; E21B 2010/564; E21B 2010/565; E21B 10/46;

(Continued)

(56) References Cited

U.S. PATENT DOCUMENTS 5,585,175 A 12/1996 Brandrup-Wognsen et al.
5,889,219 A * 3/1999 Moriguchi ..... B24B 41/00 419/13

(Continued)

FOREIGN PATENT DOCUMENTS

RU 2011649 4/1994
RU 2117066 8/1998

OTHER PUBLICATIONS

U.S. Appl. No. 13/891,040, "Final Office Action", dated Aug. 9, 2017, 11 pages.

(Continued)

*Primary Examiner* — Tara E Schimpf
(74) *Attorney, Agent, or Firm* — Kilpatrick Townsend & Stockton LLP

(57) ABSTRACT

A polycrystalline diamond compact (PDC), which is attached or bonded to a substrate to form a cutter for a drill bit, is comprised of sintered polycrystalline diamond interspersed with a seed material which has a hexagonal close packed (HCP) crystalline structure. A region of the sintered polycrystalline diamond structure, near one or more of its working surfaces, which has been seeded with an HCP seed material prior to sintering, is leached to remove catalyst. Selectively seeding portions or regions of a sintered polycrystalline diamond structure permits differing leach rates to form leached regions with differing distances or depths and geometries.

17 Claims, 2 Drawing Sheets

Related U.S. Application Data

(60) Provisional application No. 61/645,833, filed on May 11, 2012.

(51) Int. Cl.
*E21B 10/567* (2006.01)
*E21B 10/46* (2006.01)
*E21B 10/55* (2006.01)
*B24D 99/00* (2010.01)

(52) U.S. Cl.
CPC ..... *E21B 10/46* (2013.01); *E21B 10/55* (2013.01); *E21B 10/567* (2013.01); *E21B 10/5676* (2013.01); *E21B 2010/563* (2013.01); *E21B 2010/564* (2013.01)

(58) Field of Classification Search
CPC ..... E21B 10/52; E21B 10/54; E21B 10/55; E21B 10/56; E21B 10/567; E21B 10/5676; E21B 10/573; E21B 10/57; E21B 10/5735
See application file for complete search history.

(56) References Cited

U.S. PATENT DOCUMENTS 6,500,226 B1 * 12/2002 Dennis ..... B22F 3/105 419/18
10,180,032 B2 1/2019 Murdock et al.
2001/0049019 A1 * 12/2001 Drake ..... C22C 1/1094 428/408
2007/0169419 A1 * 7/2007 Davis ..... B01J 19/008 51/293
2007/0224105 A1 9/2007 Sung
2011/0061944 A1 3/2011 Scott et al.
2011/0258937 A1 10/2011 Qian et al.
2012/0037431 A1 * 2/2012 DiGiovanni ..... E21B 10/5676 175/428
2012/0085585 A1 * 4/2012 Scott ..... B22D 19/14 175/428
2012/0138370 A1 * 6/2012 Mukhopadhyay ..... B22F 7/06 175/428
2013/0075167 A1 * 3/2013 Knull ..... E21B 10/43 175/428

OTHER PUBLICATIONS

U.S. Appl. No. 13/891,040, "Non-Final Office Action", May 18, 2015, 10 pages.
U.S. Appl. No. 13/891,040, "Non-Final Office Action", dated Mar. 8, 2018, 11 pages.
U.S. Appl. No. 13/891,040, "Notice of Allowance", dated Sep. 6, 2018, 10 pages.
International Application No. PCT/US2013/040422, "International Search Report and Written Opinion", dated Sep. 12, 2013, 5 pages.

* cited by examiner

DIAMOND CUTTING ELEMENTS FOR DRILL BITS SEEDED WITH HCP CRYSTALLINE MATERIAL

CROSS REFERENCE TO RELATED APPLICATIONS

This application is a divisional of U.S. application Ser. No. 13/891,040, filed May 9, 2013, now U.S. Pat. No. 10,180,032, which claims the benefit of U.S. Ser. No. 61/645,833, filed May 11, 2012, the entire contents and disclosures of which are incorporated herein by reference.

FIELD OF INVENTION

The invention relates generally to cutting elements used for drill for earth boring drill bits.

BACKGROUND

There are two basic types of drill bits used for boring through subterranean rock formations when drilling oil and natural gas wells: drag bits and roller cone bits.

Drag bits have no moving parts. As a drag bit is rotated, typically by rotating a drill string to which it is attached, discrete cutting elements ("cutters") affixed to the face of the bit drag across the bottom of the well, scraping or shearing the formation. Each cutter of a rotary drag bit is positioned and oriented on a face of the drag bit so that a portion of it, which will be referred to as its wear surface, engages the earth formation as the bit is being rotated. The cutters are spaced apart on an exterior cutting surface or face of the body of a drill bit in a fixed, predetermined pattern. The cutters are typically arrayed along each of several blades, which are raised ridges extending generally radially from the central axis of the bit, toward the periphery of the face, usually in a sweeping manner (as opposed to a straight line). The cutters along each blade present a predetermined cutting profile to the earth formation, shearing the formation as the bit rotates. Drilling fluid pumped down the drill string, into a central passageway formed in the center of the bit, and then out through ports formed in the face of the bit, both cools the cutters and helps to remove and carry cuttings from between the blades.

Roller cone bits are comprised of two or three cone-shaped cutters that rotate on an axis at a thirty-five degree angle to the axis of rotation of the drill bit. As the bit is rotated, the cones roll across the bottom of the hole. Cutting elements—also called cutters—on the surfaces of the cones crush the rock as they pass between the cones and the formation.

In order to improve performance of drill bits, one or more wear or working surfaces of the cutting elements are made from a layer of polycrystalline diamond ("PCD") in the form of a polycrystalline diamond compact ("PDC") that is attached to a substrate. A common substrate is cemented tungsten carbide. When PDC is made, it is bonded to the substrate, and PDC bonded to the substrate comprising the cutter. Drag bits with such PDC cutting elements are sometimes called "PDC bits." PDC, though very hard with high abrasion or wear resistance, tends to be relatively brittle. The substrate, while not as hard, is tougher than the PDC, and thus has higher impact resistance. The substrate is typically made long enough to act as a mounting stud, with a portion of it fitting into a pocket or recess formed in the body of the drag bit or, the case of a roller cone bit, in the packet formed in a roller. However, in some drag bits, the PDC and the substrate structure have been attached to a metal mounting stud, which is then inserted into a pocket or other recess.

A polycrystalline diamond compact is made by mixing the polycrystalline diamond in powder form with one or more powdered metal catalysts and other materials, forming the mixture into a compact, and then sintering it using high heat and pressure or microwave heating. Although cobalt or an alloy of cobalt is the most common catalyst, other Group VIII metal, such as nickel, iron and alloys thereof can be used as catalyst. For a cutter, a PDC is typically formed by packing polycrystalline diamond grains (referred to as "diamond grit") without the metal catalyst adjacent a substrate of cemented tungsten carbide, and then sintering the two together. During sintering metal binder in the substrate—cobalt in the case of cobalt cemented tungsten carbide—sweeps into or infiltrates the compact, acting as a catalyst to cause formation of diamond-to-diamond bonds between adjacent diamond grains. The result is a mass of bonded diamond crystals, which has been described as continuous or integral matrix of diamond and even a "lattice," having interstitial voids between the diamond at least partly filled with the metal catalyst.

Substrates for supporting a PDC layer are made, at least in part, from cemented metal carbide, with tungsten carbide being the most common. Cemented metal carbide substrates are formed by sintering powdered metal carbide with a metal alloy binder. The composite of the PDC and the substrate can be fabricated in a number of different ways. It may also, for example, include transitional layers in which the metal carbide and diamond are mixed with other elements for improving bonding and reducing stress between the PDC and substrate. References herein to substrates include such substrates.

Because of the presence of metal, catalyst PDC exhibits thermal instability. Cobalt has a different coefficient of expansion to diamond. It expands at a greater rate, thus tending to weaken the diamond structure at higher temperatures. Furthermore, the melting point of cobalt is lower than diamond, which can lead to the cobalt causing diamond crystals within the PDC to begin to graphitize when temperatures reach or exceed the melting point, also weakening the PDC. To make the PDC at least more thermally stable, a substantial percentage—usually more than 50%; often 70% to 85%; and possibly more—of the catalyst is removed from at least a region next to one or more working surfaces that experience the highest temperatures due to friction. The catalyst is removed by a leaching process that involves placing the PDC in a hot strong acid, examples of which include nitric acid, hydrofluoric acid, hydrochloric acid, or perchloric acid, and combinations of them. In some cases, the acid mix may be heated and/or agitated to accelerate the leaching process.

Removal of the cobalt is, however, thought to reduce toughness of the PDC, thus decreasing its impact resistance. Furthermore, leaching the PDC can result in removal of some of the cobalt that cements or binds the substrate, thus affecting the strength or integrity of the substrate and/or the substrate to diamond interface. As a result of these concerns, leaching of cutters is now "partial," meaning that catalyst is removed only from a region of the PDC, usually defined in terms of a depth or distance measured from a working surface or working surfaces of the PDC, including the top, beveled edge, and/or side of the cutter.

There is a technical limit to the depth to which a PCD can be leached without damaging the substrate or the bond between the substrate and PCD. That technical limit concerns the mask and seal that protects the substrate from the acid bath in which the cutter is placed for leaching. The seals are made of materials that tends to break down over time when exposed to the acids used to leach the PCD, therefore limiting the duration of the leaching and thus the depth that can be achieved. Furthermore, as diamond grain sizes decrease, in some cases to nano particle size (less then 100 nanometers), the diamond structure in the PCD becomes much more dense and consequently it becomes impractical to leach to any useful depth (such as deep leached depths of greater than 100 microns). At the very least, these denser structures are much more difficult to leach, requiring much longer leaching times.

SUMMARY

The invention pertains to improved cutting elements for earth boring drill bits, to methods for making such cutting elements, and to drill bits utilizing such cutting elements.

In one example of an improved cutting element, a polycrystalline diamond compact (PDC), which is attached or bonded to a substrate to form a cutter for a drill bit, is comprised of sintered polycrystalline diamond interspersed with a seed material which has a hexagonal close packed (HCP) crystalline structure.

In another example of an improved PDC cutting element, a region of a sintered polycrystalline diamond structure, near one or more of its working surfaces, which has been seeded with an HCP seed material prior to sintering, is leached to remove catalyst. Regions with the HCP seed material leach more quickly as compared to regions of the sintered polycrystalline diamond structure without the HCP seed material, allowing deeper leaching than otherwise possible due to technical limitations of PCD made without any seeding material. Fast leaching has a particular advantage with polycrystalline diamond feeds that include particles that are less than 30 microns particle in size. Selectively seeding portions or regions of a sintered polycrystalline diamond structure also permits taking advantage of differing leach rates to form leached regions with differing distances or depths and geometries.

DETAILED DESCRIPTION OF EXEMPLARY EMBODIMENTS

In the following description, like numbers refer to like elements.

Figure 1:
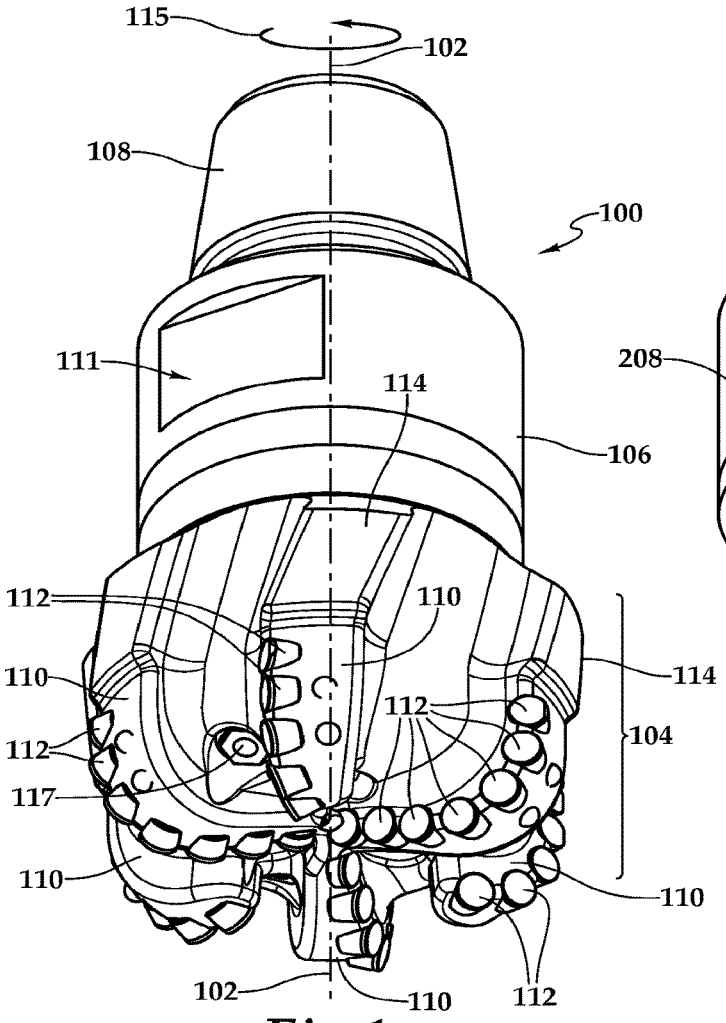
FIG. 1 is a perspective view of a PDC drag bit.

FIG. 1 illustrates an example 100 of a PDC drag bit. However, it is intended to be a representative example of drag bits and, in general, drill bits for drilling oil and gas wells. It is designed to be rotated around its central axis 102. It is comprised of a bit body 104 connected to a shank 106 having a tapered threaded coupling 108 for connecting the bit to a drill string and a "bit breaker" surface 111 for cooperating with a wrench to tighten and loosen the coupling to the drill string. The exterior surface of the body intended to face generally in the direction of boring is referred to as the face of the bit. The face generally lies in a plane perpendicular to the central axis 102 of the bit. The body is not limited to any particular material. It can be, for example, made of steel or a matrix material such as powdered tungsten carbide cemented by metal binder.

Disposed on the bit face are a plurality of raised "blades," each designated 110, that rise from the face of the bit. Each blade extends generally in a radial direction, outwardly to the periphery of the cutting face. In this example, there are six blades substantially equally spaced around the central axis and each blade, in this embodiment, sweeps or curves backwardly in the direction of rotation indicated by arrow 115.

On each blade is mounted a plurality of discrete cutting elements, or "cutters," 112. Each discrete cutting element is disposed within a recess or pocket. In a drag bit the cutters are placed along the forward (in the direction of intended rotation) side of the blades, with their working surfaces facing generally in the forward direction for shearing the earth formation when the bit is rotated about its central axis. In this example, the cutters are arrayed along blades to form a structure cutting or gouging the formation and then pushing the resulting debris into the drilling fluid which exits the drill bit through the nozzles 117. The drilling fluid in turn transports the debris or cuttings uphole to the surface.

In this example of a drag bit, all of the cutters 112 are PDC cutters. However, in other embodiments, not all of the cutters need to be PDC cutters. The PDC cutters in this example have a working surface made primarily of super hard, polycrystalline diamond, or the like, supported by a substrate that forms a mounting stud for placement in a pocket formed in the blade. Each of the PDC cutters is fabricated discretely and then mounted—by brazing, press fitting, or otherwise—into pockets formed on bit. However, the PDC layer and substrate are typically used in the cylindrical form in which they are made. This example of a drill bit includes gauge pads 114. In some applications, the gauge pads of drill bits such as bit 100 can include an insert of thermally stable, sintered polycrystalline diamond (TSP).

Figure 2A:
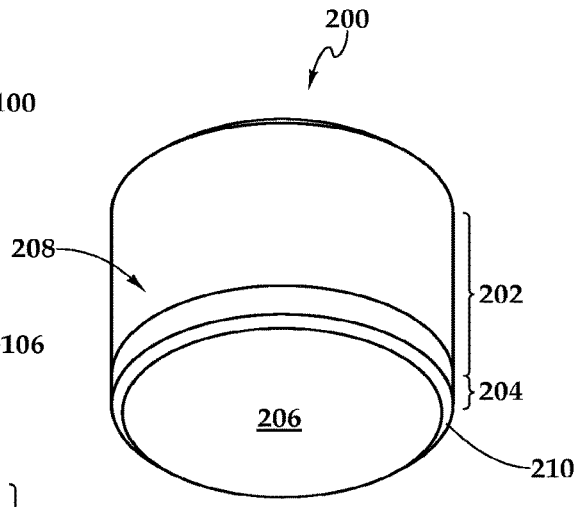
FIGS. 2A, 2B and 2C are perspective, side and top views, respectively, of a representative PDC cutter suitable for the drag bit of FIG. 1.
Figure 2B:
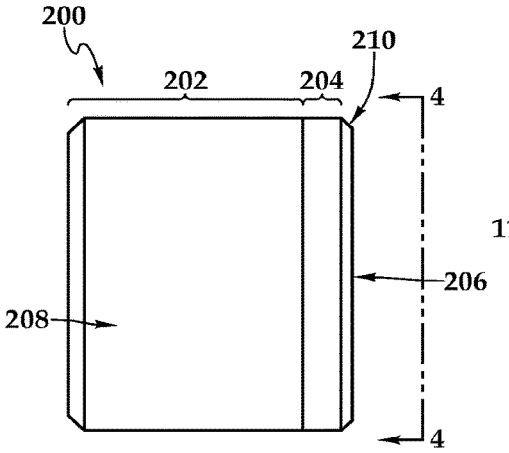
Figure 2C:
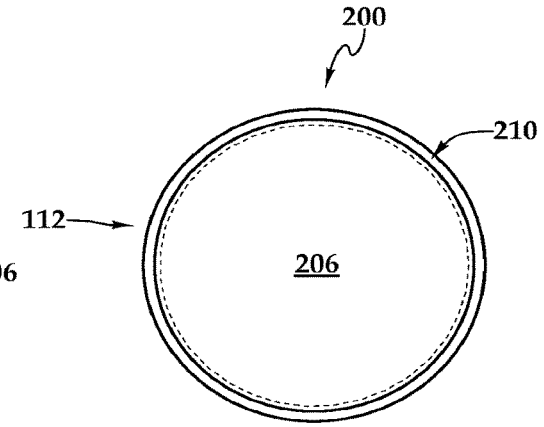

FIGS. 2A-2C illustrate examples of a PDC cutter 200. It is comprised of a substrate 202, to which is attached a layer of sintered polycrystalline diamond (PCD) 204. This layer is sometimes also called a diamond table. Note that the cutter is not drawn to scale and intended to be representative of cutters generally that have a polycrystalline diamond structure attached to a substrate, and in particular the one or more of the PDC cutters 112 on the drill bit 100 of FIG. 1. Although frequently cylindrical in shape, PDC cutters in general are not limited to a particular shape, size or geometry, or to a single layer of PCD. In this example, an edge between top surface 206 and side surface 208 of the diamond layer 204 is beveled to form a beveled edge 210. The top surface and the beveled surface are, in this example, each a working surface for contacting and cutting through the formation. A portion of the side surface, particularly nearer the top, may also come into contact with the formation or debris. Not all of the cutters on a bit must be of the same size, configuration, or shape. In addition to being sintered with different sizes and shapes, PDC cutters can be cut, ground, or milled to change their shapes. Furthermore, the cutter could have multiple discrete PCD structures. Other examples of possible cutter shapes might pre-flatted gauge cutters, pointed or scribe cutters, chisel-shaped cutters, and dome inserts.

Referring now also, in addition to FIGS. 2A to 2C, to FIGS. 3A to 3C and 4, the diamond structure comprising the diamond layer 204 has at least one, discrete region or area within it interspersed with grains of a crystalline seed material. An example of such crystalline seed is material having a hexagonal close pack (HCP) structure. Examples of such HCP crystalline seed material include materials with having a wurtzite crystal structure, including for example wurtzite boron nitride (BNw), wurtzite silicon carbide, and Lonsdaleite (hexagonal diamond).

The diamond structure is formed by mixing small or fine grains of synthetic or natural diamond, referred to within the industry as diamond grit, with grains of HCP seed material (with or without additional materials) according to a predetermined proportion to obtain a desired concentration. A compact is then formed either entirely of the mixture or, alternately, the compact is formed with the mixture discrete regions or volumes within the compact—containing the mixture and the remaining portion of the compact (or at least one other region of the compact) comprising PCD grains (with any additional material) but not the HCP seed material. The formed compact is then sintered under high pressure and high temperature in the presence of a catalyst, such as cobalt, a cobalt alloy, or any group VIII metal or alloy. The catalyst may be infiltrated into the compact by forming the compact on a substrate of tungsten carbide that is cemented with the catalyst, and then sintering. The result is a sintered PCD structure with at least one region containing HCP seed material dispersed throughout the region in the same proportion as the mixture.

The HCP seed material may have a grain size of between 0 and 60 microns in one embodiment, between 0 and 30 microns, and between 0 and 10 microns in another embodiment. The grains of PCD in the mixture may be within the range of 0 to 40 microns, and may be as small as nano particle size. The proportion or concentration of HCP seed material within the mixture, and thus within the region seeded with the HCP seed material, is in one embodiment 5% or less by volume. In another embodiment it is in the range 0.05% to 2% by volume and in a further embodiment, in the range of 0.05% to 0.5% by volume.

The PCD may be layered within the compact according to grain size. For example, a layer next to a working layer will be comprised of finer grains (i.e. grains smaller than a predetermined grain size) and a layer further away, perhaps a base layer next to the substrate, with grain larger than the predetermined size. The HCP seed material can be mixed with only the finer grain diamond grit mix to form a first region or layer next to a working surface, or with multiple layers of diamond grit mix.

Alternately, mixtures having different concentrations or proportions of HCP seed material within the diamond layer may form a plurality of different regions or layers in the diamond structure, with or without having HCP seed material in the remaining structure of the PCD layer.

In another, alternate example, the HCP material is replaced with a crystalline seed material (other than diamond) having a zinc blend crystalline structure, which is a type of face centered cubic (FCC) structure. Examples of such material include cubic boron nitride.

It is believed that PCD seeded with an HCP crystalline seed material, particularly BNw, as described above results in a sintered polycrystalline diamond structure with faster leaching times. Furthermore, it is believed a PDC cutter with diamond layer that is formed according to the method described above with HCP seed material, and in particular with BNw as a seed material, performs better than the same PDC cutter with diamond structure formed without HCP seed material due to increased fracture toughness and abrasion resistance.

Figure 3C:
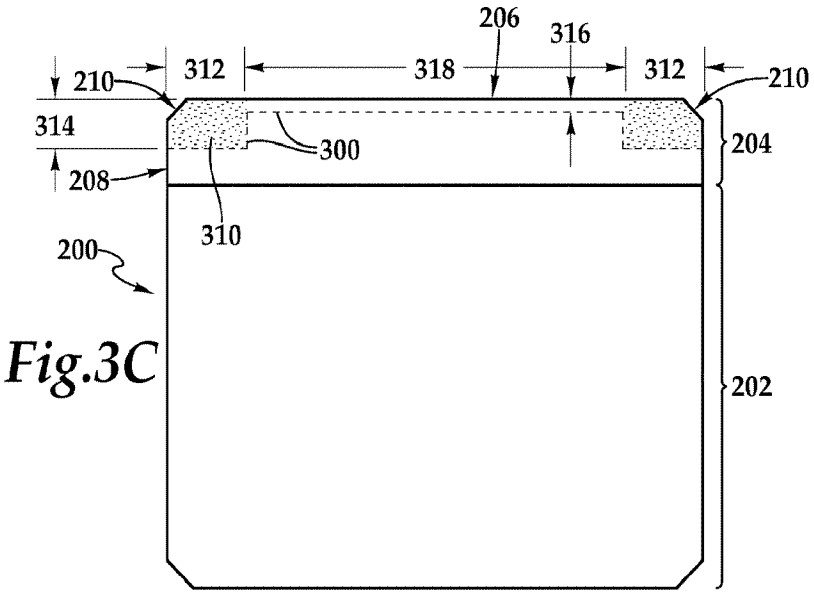
FIGS. 3A, 3B and 3C are cross-sections through four different examples of the PDC cutter of FIGS. 2A-2C, that has been seeded with HCP material in discrete regions within its diamond structure and then leached to partially or completely remove catalyst from at least the seeded region.
Figure 3A:
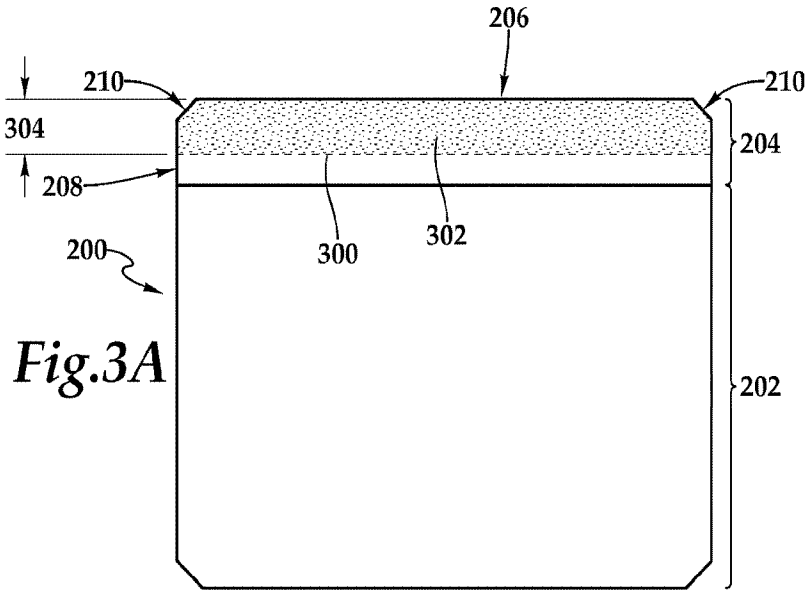
Figure 3B:
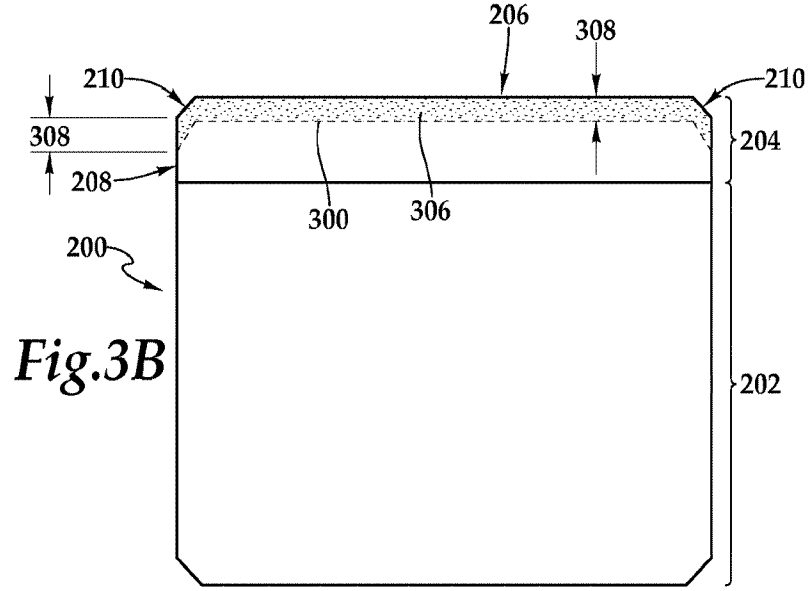

In the different embodiments of PDC cutter 200 shown in FIGS. 3A to 3C, the regions or portion of the sintered PCD diamond layer or structure 204 in which an HCP seed material (the "seeded regions") is interspersed is generally indicated by stippling, and the depth to which the diamond layer is partially leached is indicated by dashed line 300. In each of the examples the seeded region is adjacent the top surface 206 and the beveled peripheral edge surface 210, each of which is a working surface.

In the embodiment of FIG. 3A, the region of seeding 302 extends across the entire top surface of diamond layer 204, and down a portion of its sides. It extends downwardly from the top surface 206 to a uniform depth 304 as measured from the top surface and is less than the thickness of the PCD layer. As indicated by the dashed line 300 the diamond layer is leached to the depth 304, the leaching removing a substantial percentage of the metal catalyst remaining in the diamond layer after sintering as compared to unleached regions.

The seeded region 306 of the embodiment of FIG. 3B also extends, like the embodiment of FIG. 3A, across the full face of the diamond layer 204. The region extends a distance 308 down the side surface 208 that is approximately the same distance as the seeded region 302 is from the top surface of the embodiment of FIG. 3A, as shown by depth 304. However, unlike the embodiment of FIG. 3A, the seeded region extends a depth from the top surface that is approximately the distance 308, which is substantially less than the depth 304 of FIG. 3A. Because the rate of leaching is relatively faster in the seeded region 306 than the unseeded regions of the diamond layer, the leaching pattern, indicated by line 300, can be made substantially coincident with the seeded region's boundary.

The embodiment of FIG. 3C has an annular shaped seeded region 310 that extends inwardly from the periphery of top surface 206, shown as 208 of FIG. 3C, by a distance 312 (which is less than the radius of the top surface) and to a depth 314 as measured from the top surface 206. This embodiment is leached to a depth indicated by a dashed line 300. Because the leaching rate is faster for the seeded region 310, leach depth 314 in the seeded region 310 is greater than the leach depth 316 in an unseeded region under the portion of top surface 206, shown as region 318.

Figure 4:
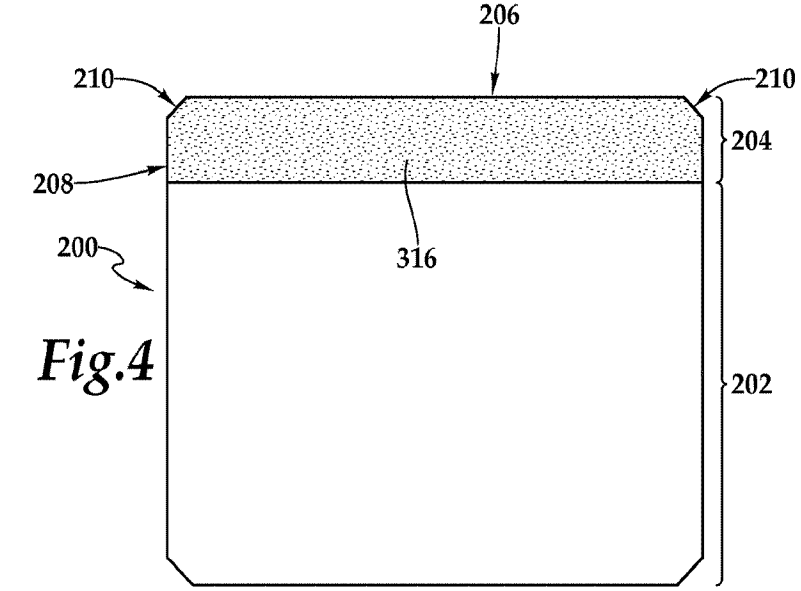
FIG. 4 is a cross section of an embodiment of the PDC cutter of FIGS. 2A-2C with HCP seed material interspersed throughout the diamond layer.

In the embodiment of FIG. 4 the entire diamond layer 204 is seeded with HCP crystalline material. For diamond mixes of 0-10 microns, particularly if the pressing pressures are very higher, the resultant PCD tends to be very dense. This increased density leads to considerable increases in leaching times. It is believed that this is due to the PCD microstructure having relatively little interstitial space, thus inhibiting the access of the leaching acid to the group VIII metal catalyst. For instance, if the PCD layer is comprised of diamond grit with grain sizes of 0-10 microns, pressed at elevated pressure, the practical limitation in leach depth will be of the order of 250 microns. This is due to the degradation of the sealing materials used to prevent the acid from contact the substrate. If nano particles are used in the diamond grit, this practical leaching depth will reduce further as the diamond density increases further, such that the benefits of leaching become negligible. The addition of the HCP seeding material makes it practical to leach fine grained diamond feed PCD, with grain sizes less than 20 microns, to depths well in excess of 500 microns, and in some embodiments in excess of 1200 microns.

The foregoing description is of exemplary and preferred embodiments. The invention, as defined by the appended claims, is not limited to the described embodiments. Alterations and modifications to the disclosed embodiments may be made without departing from the invention. The meaning of the terms used in this specification are, unless expressly stated otherwise, intended to have ordinary and customary meaning and are not intended to be limited to the details of the illustrated or described structures or embodiments.

What is claimed is:

1. A method of fabricating a sintered polycrystalline diamond structure for an earth boring drill bit, comprising:

mixing grains of hexagonal close packed (HCP) seed material with grains of diamond grit mix to form a mixture;

forming a compact for sintering, the compact containing diamond grit mix throughout, at least a portion of the compact containing the mixture of HCP seed material and diamond grit mix;

sintering the compact in the presence of a catalyst to thereby form a diamond structure comprising an integral mass of sintered polycrystalline diamond (PCD) exhibiting diamond-to-diamond bonding, the catalyst occupying voids therein, the compact being at least partially interspersed with the HCP seed material, and leaching the catalyst from the diamond structure to a predetermined depth using an acid;

wherein the predetermined depth is greater than 500 microns; and wherein the sizes of the grains of polycrystalline diamond in the mixture are less than 30 microns.

2. The method of claim 1, wherein the catalyst is comprised of metal.

3. The method of claim 1, wherein the HCP seed material possesses a wurtzite crystalline structure.

4. The method of claim 1, wherein the HCP seed material is chosen from the group consisting essentially of wurtzite boron nitride, wurtzite silicon carbide, and Lonsdaleite.

5. The method of claim 1, wherein the HCP seed material is comprised of wurtzite boron nitride.

6. The method of claim 1 wherein the sizes of the grains of HCP seed material are less than 40 microns.

7. The method of claim 1 wherein the sizes of the grains of polycrystalline diamond in the mixture are less than 100 nanometers in at least one dimension.

8. The method of claim 1, wherein the HCP seed material comprises less than 5% by volume of the mixture.

9. The method of claim 8, wherein the HCP seed material comprises less than 1% by volume of the mixture.

10. The method of claim 8, wherein the amount of HCP seed material in the mixture comprises an amount between 0.05% and 0.5% of the mixture by volume.

11. The method of claim 1, wherein the compact has a plurality of surfaces, at least one of which is a working surface; and wherein the compact has at least one discrete region that is adjacent the working surface that contains the mixture, and at least one other discrete region not containing the mixture.

12. The method of claim 1, wherein the mixture is located in at least one discrete region within the compact, and wherein the compact has at least one other discrete region with PCD devoid of HCP seed material.

13. The method of claim 1, wherein the mixture has a first proportion of HCP seed material to PCD, and wherein the method further comprises mixing grains of diamond grit mix with grains of HCP seed material in a second proportion different from the first proportion, and wherein forming the compact comprises at least one discrete region of the mixture with the first proportion of HCP seed material and PCD and at least one other discrete region of the mixture of the HCP seed material and PCD in the second proportion.

14. The method of claim 1, wherein the compact is formed with a plurality of surfaces, at least one of which is a working surface and at least one of which is a bottom surface; and wherein the compact is formed with at least two layers of PCD, a first layer of PCD having grains of a first size or size range adjacent the working surface, and a second layer nearer the bottom surface having grains of PCD larger than the first size or size range.

15. The method of any of claim 1, wherein, the compact has a plurality of surfaces, at least one of which is a working surface; the compact has at least one discrete region that is adjacent the working surface that contains the mixture, and at least one other discrete region not containing the mixture; and the method further comprises leaching catalyst from the diamond structure from the at least one discrete region containing the mixture.

16. The method of claim 1, wherein, the compact has a plurality of surfaces, at least one of which is a working surface;

the compact has at least one discrete region that is adjacent the working surface that contains the mixture, and a region not containing the mixture; and the method further comprises leaching from the diamond structure metal catalyst in at least a portion of both the at least one discrete region containing the mixture and the region not containing the mixture.

17. The method of claim 1, wherein the predetermined depth is greater than 1200 microns.

* * * * *